US006464189B1

(12) United States Patent
Yu

(10) Patent No.: US 6,464,189 B1
(45) Date of Patent: Oct. 15, 2002

(54) HANGER DEVICE

(76) Inventor: Ming-Ti Yu, 122-5, Jun Liao Rd., Feng Yuan, Taichung Hsien (TW)

( * ) Notice: Subject to any disclaimer, the term of this patent is extended or adjusted under 35 U.S.C. 154(b) by 0 days.

(21) Appl. No.: 10/002,989

(22) Filed: Oct. 26, 2001

(51) Int. Cl.[7] ..... A47H 1/10; G10G 5/00

(52) U.S. Cl. ..... 248/323; 248/221.11; 248/224.7; 84/327

(58) Field of Search ..... 248/323, 221.11, 248/222.13, 223.41, 224.7, 290.1, 309.1, 312, 312.1, 304; 84/327, 453, 328, 329, 280, 281

(56) References Cited

U.S. PATENT DOCUMENTS

| | | | | | |
|---|---|---|---|---|---|
| 309,349 | A | * | 12/1884 | Hart | 248/286.1 |
| 888,032 | A | * | 5/1908 | Peterson | 248/215 |
| 896,721 | A | * | 8/1908 | Goldenberg | 84/281 |
| 1,848,430 | A | * | 3/1932 | Morris | 248/289.11 |
| 3,329,385 | A | * | 7/1967 | Dietsch | 248/290.1 |
| 4,131,259 | A | * | 12/1978 | Franks | 211/75 |
| 4,182,505 | A | * | 1/1980 | Cobin | 150/154 |
| D281,576 | S | * | 12/1985 | Akers | D8/373 |
| D308,782 | S | * | 6/1990 | Getsi | D6/567 |
| 4,991,809 | A | * | 2/1991 | Harkey | 248/229.12 |
| 5,078,276 | A | * | 1/1992 | Rogge et al. | 211/18 |
| D329,349 | S | * | 9/1992 | Moreno | D6/567 |
| 5,219,134 | A | * | 6/1993 | Morita et al. | 248/224.7 |
| 5,372,346 | A | * | 12/1994 | Upchurch et al. | 248/222.52 |
| 6,091,008 | A | * | 7/2000 | Yu | 248/220.41 |
| 6,204,440 | B1 | * | 3/2001 | Yu | 248/220.41 |
| 6,231,018 | B1 | * | 5/2001 | Barbieri | 248/302 |

* cited by examiner

*Primary Examiner*—Anita King
*Assistant Examiner*—Naschica S. Morrison

(57) ABSTRACT

A hanger device has a support seat, a control rod, and a cantilever. The support seat has an upper lug, a pair of middle lugs, a semicircular slot, a plurality of threaded holes, and a longitudinal through aperture. The upper lug has a center hole and a plurality of grooves. A post is disposed on the control rod. The cantilever has a distal end and a proximal end having a through hole. The proximal end of the cantilever is inserted in the semicircular slot of the support seat. The control rod passes through the center hole of the upper lug, the longitudinal through aperture of the support seat, and the through hole of the proximal end of the cantilever.

8 Claims, 7 Drawing Sheets

HANGER DEVICE

BACKGROUND OF THE INVENTION

The present invention relates to a hanger device. More particularly, the present invention relates to a hanger device which is easily detached.

A conventional clotheshorse cannot be used as a music instrument hanger. Further, an angle of a conventional music instrument hanger cannot be adjusted.

SUMMARY OF THE INVENTION

An object of the present invention is to provide a hanger device which is easily detached.

Another object of the present invention is to provide a hanger device which has a post of a control rod inserted in a groove of an upper lug of a support seat so that a cantilever is fixed stably.

Another object of the present invention is to provide a hanger device which has a post of a control rod not inserted in a groove of an upper lug of a support seat so that a cantilever is rotated freely.

Another object of the present invention is to provide a hanger device which has at least a dumbbell-shaped spool disposed on a cantilever in order to hang an article.

Accordingly, a hanger device comprises a support seat, a control rod, and a cantilever. The support seat has an upper lug, a pair of middle lugs, a semicircular slot formed between the middle lugs, a plurality of threaded holes, and a longitudinal through aperture communicating with the semicircular slot. The upper lug has a center hole communicating with the longitudinal through aperture of the support seat, and a plurality of grooves communicating with the center hole. A post is disposed on the control rod. The cantilever has a distal end and a proximal end having a through hole. The proximal end of the cantilever is inserted in the semicircular slot of the support seat. The control rod passes through the center hole of the upper lug, the longitudinal through aperture of the support seat, and the through hole of the proximal end of the cantilever. The post of the control rod is inserted in one of the grooves of the upper lug.

DETAILED DESCRIPTION OF THE INVENTION

Figure 1:
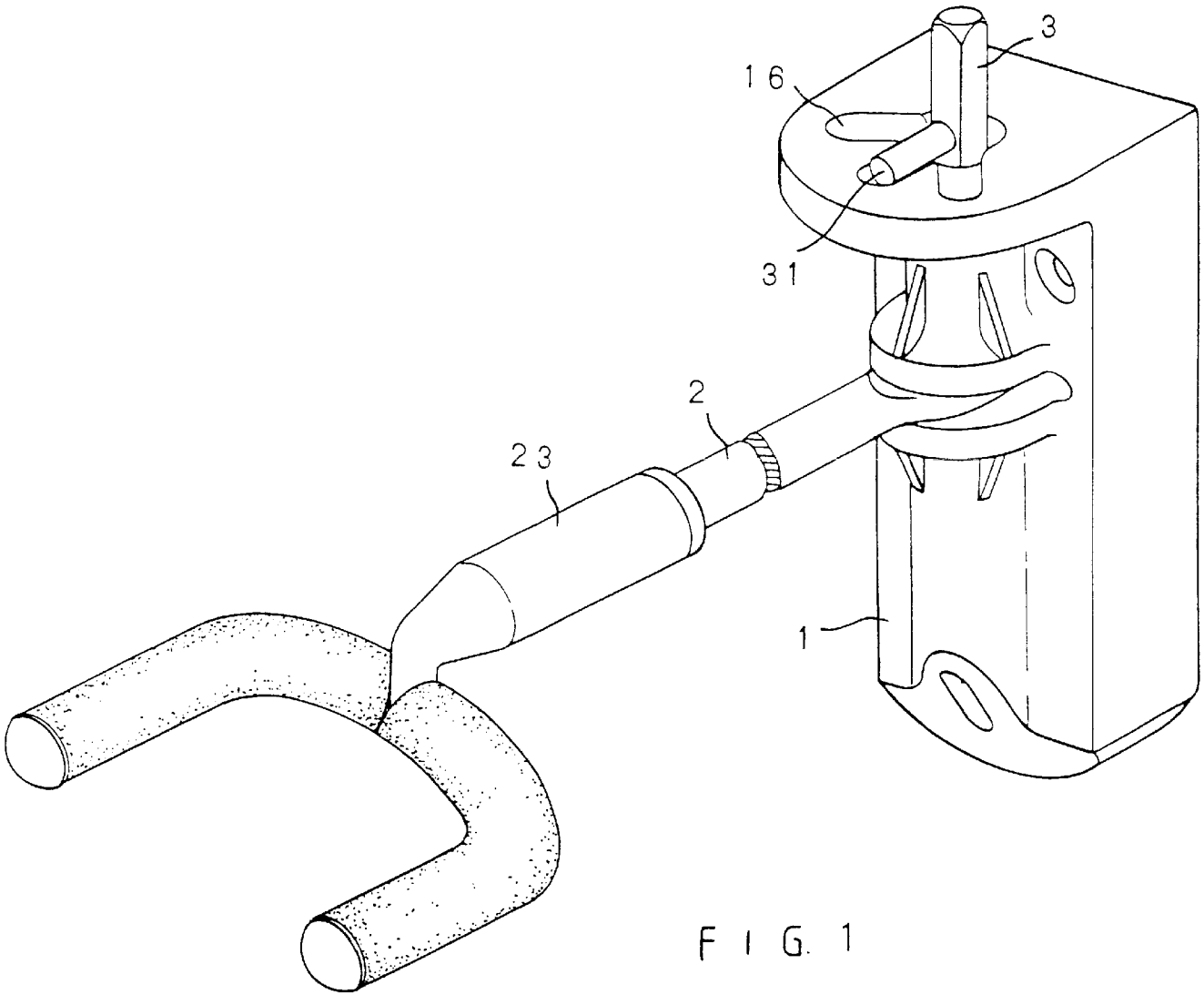
FIG. 1 is a perspective assembly view of a hanger device of a first referred embodiment in accordance with the present invention.
Figure 2:
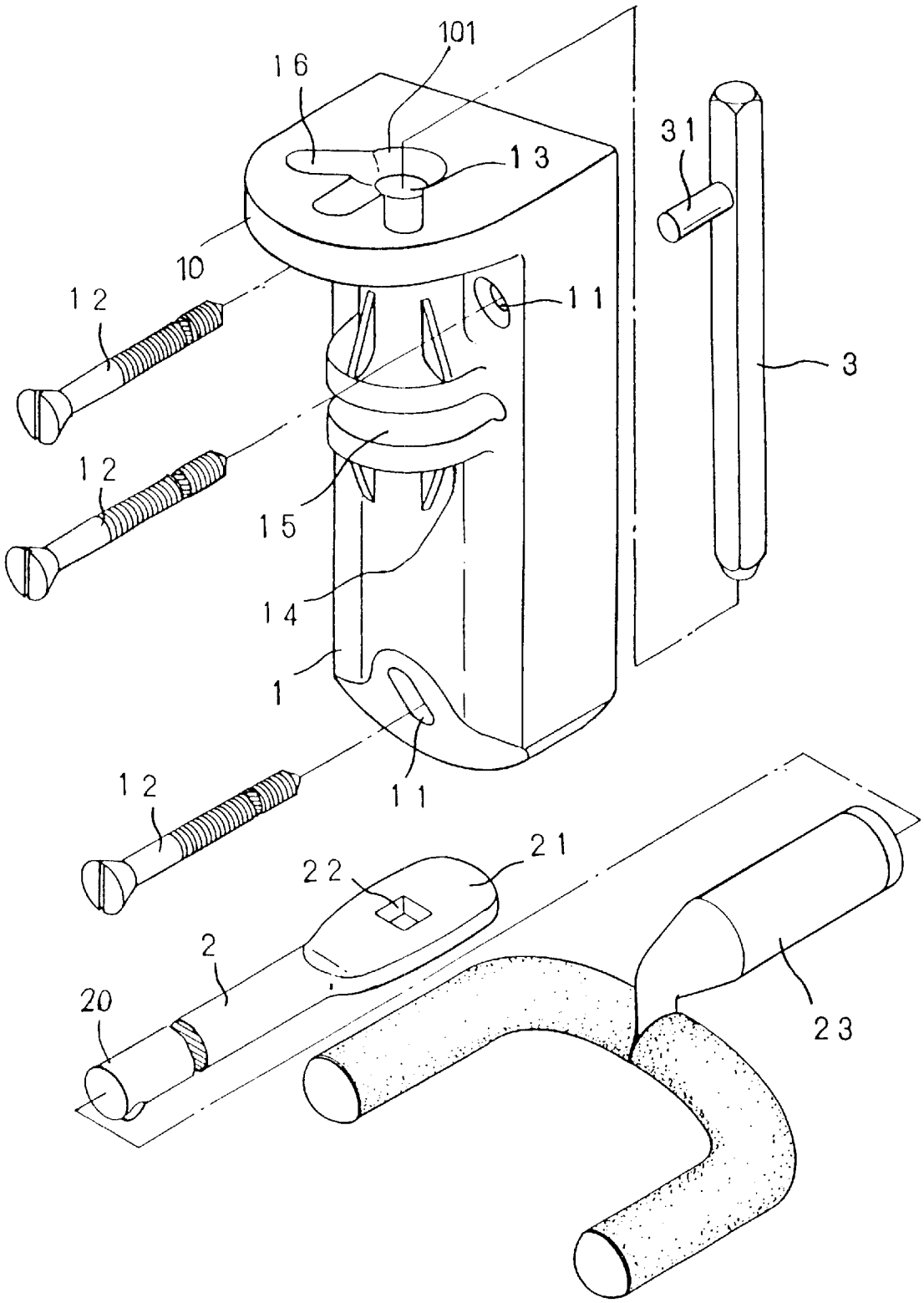
FIG. 2 is a perspective exploded view of a hanger device of a first preferred embodiment in accordance with the present invention.
Figure 3:
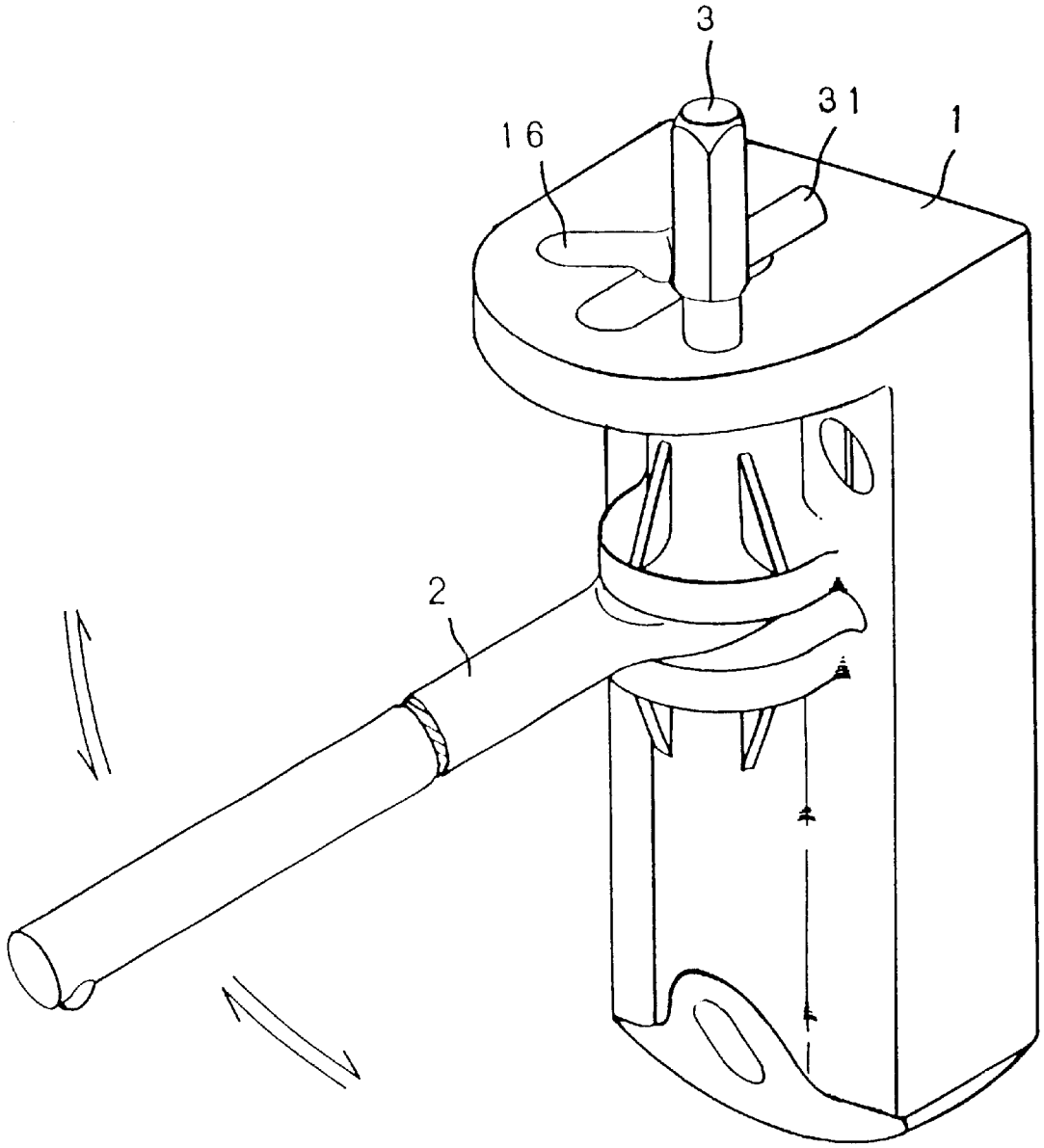
FIG. 3 is a schematic view illustrating a post of a control rod is rotated backward so that the post of the control rod is not inserted in a groove of an upper lug of a support seat of a first preferred embodiment in accordance with the present invention.

Referring to FIGS. 1 to 3, 7 and 8, a first hanger device comprises a support seat 1, a control rod 3, and a cantilever 2. The support seat 1 is generally in an oblong shape.

The support seat 1 has an upper lug 10, a pair of middle lugs 14, a semicircular slot 15 formed between the middle lugs 14, a plurality of threaded holes 11, and a longitudinal through aperture 13 communicating with the semicircular slot 15.

The upper lug 10 has a center hole 101 communicating with the longitudinal through aperture 13 of the support seat 1, and a plurality of grooves 16 communicating with the center hole 101.

A plurality of bolts 12 passes through the threaded holes 11 of the support seat 1 to fasten the support seat 1 on a wall (not shown in the figures).

A post 31 is disposed on the control rod 3.

The cantilever 2 has a distal end 20 and a proximal end 21 having a through hole 22.

The proximal end 21 of the cantilever 2 is inserted in the semicircular slot 15 of the support seat 1.

The control rod 3 passes through the center hole 101 of the upper lug 10, the longitudinal through aperture 13 of the support seat 1, and the through hole 22 of the proximal end 21 of the cantilever 2.

The post 31 of the control rod 3 is inserted in one of the grooves 16 of the upper lug 10.

The upper lug 10 and the middle lugs 14 are in semicircular shapes.

The cantilever 2 is made of metal.

A hanger tube 23 surrounds the distal end 20 of the cantilever 2.

The control rod 3 has a square cross-section.

The through hole 22 of the proximal end 21 of the cantilever 2 is in a square shape.

When the cantilever 2 rotates in one direction, the cantilever 2 will rotate in accordance with the direction of the cantilever 2.

If the post 31 of the control rod 3 is inserted in one of the grooves 16 of the upper lug 10 of the support seat 1, the cantilever 2 is fixed stably.

If the post 31 of the control rod 3 is not inserted in one of the grooves 16 of the upper lug 10 of the support seat 1, the cantilever 2 is rotated freely.

Figure 4:
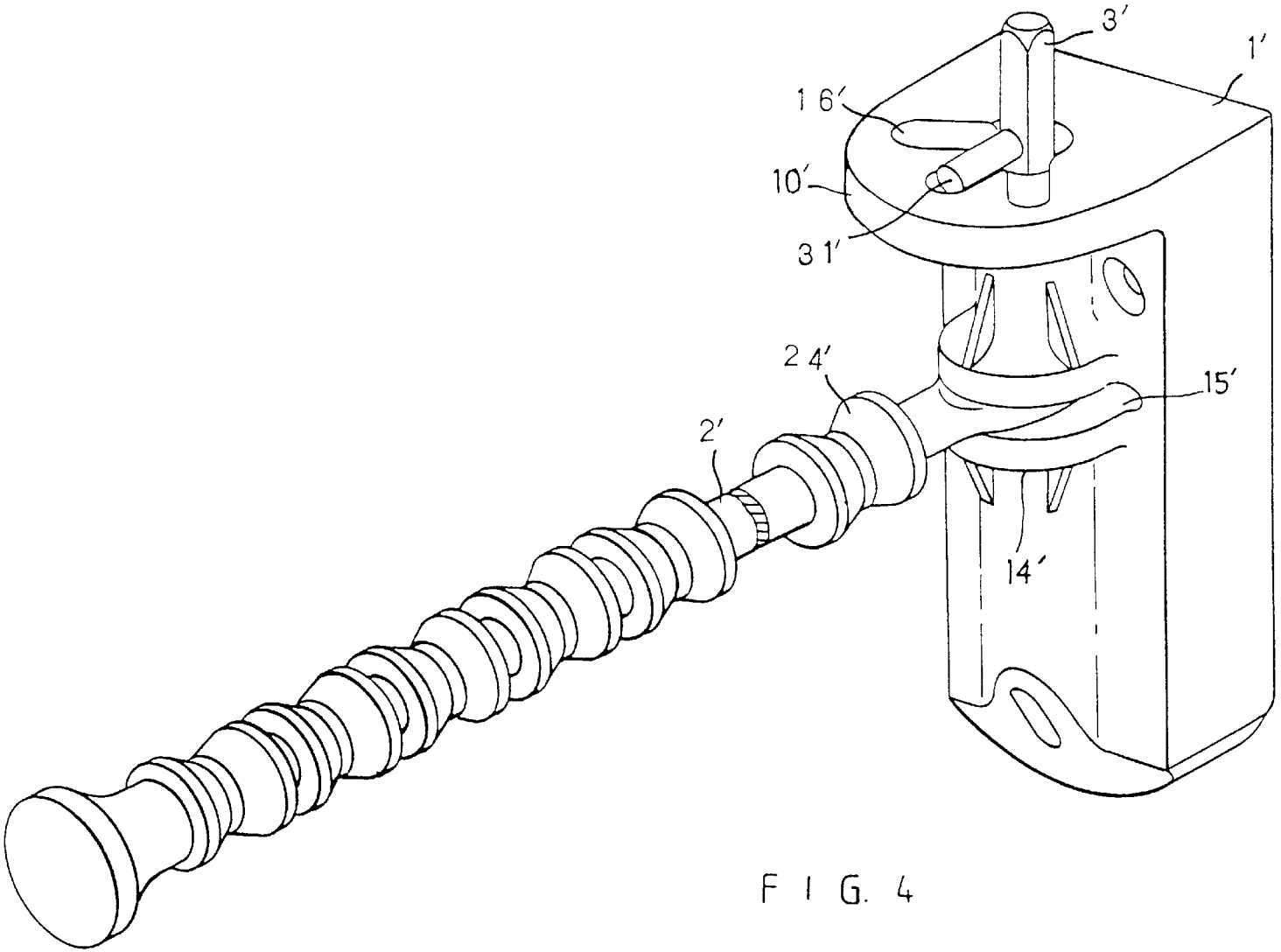
FIG. 4 is a perspective assembly view of a hanger device of a second preferred embodiment in accordance with the present invention.
Figure 5:
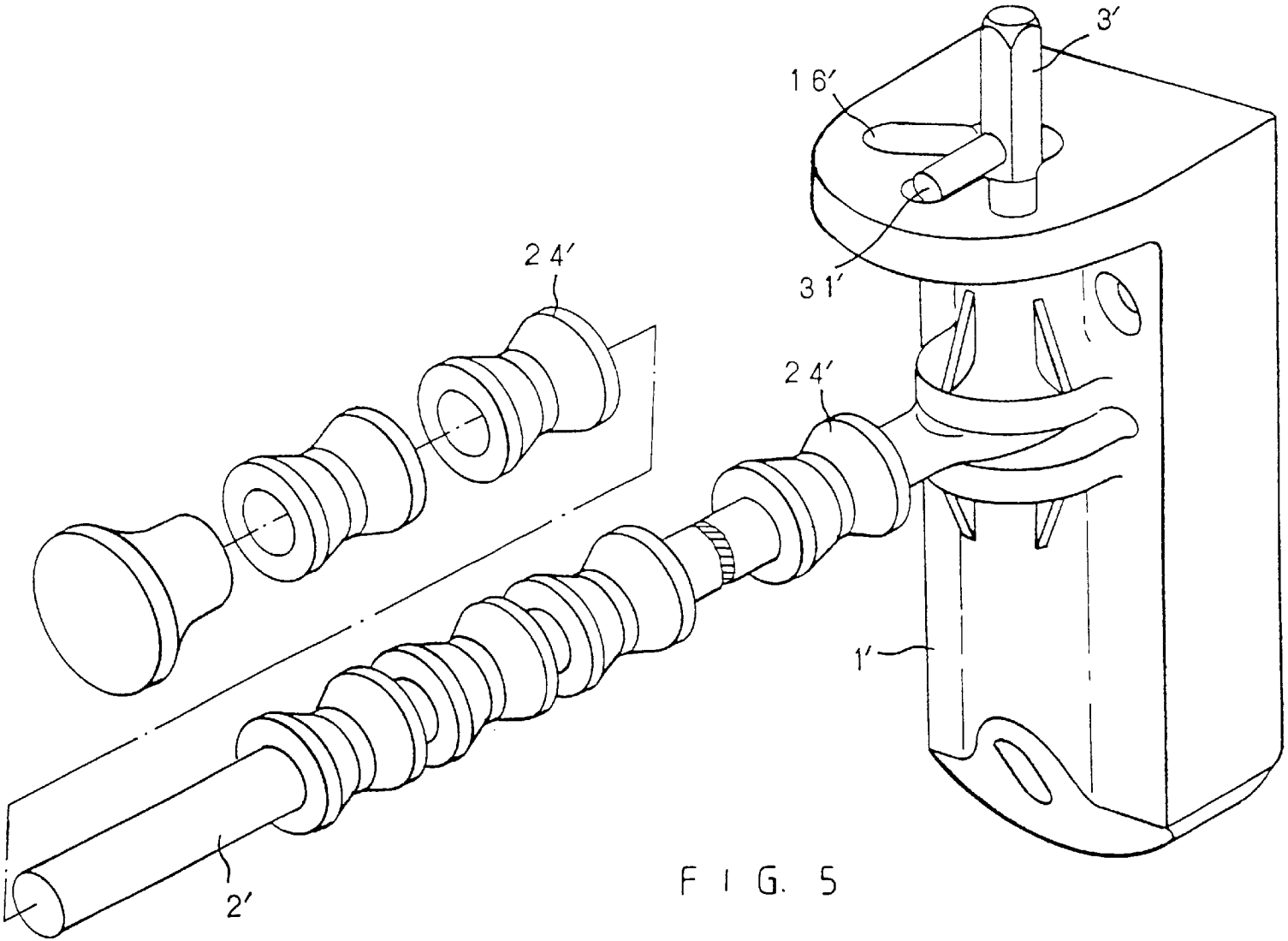
FIG. 5 is a partially perspective exploded view of a hanger device of a second preferred embodiment in accordance with the present invention.
Figure 6:
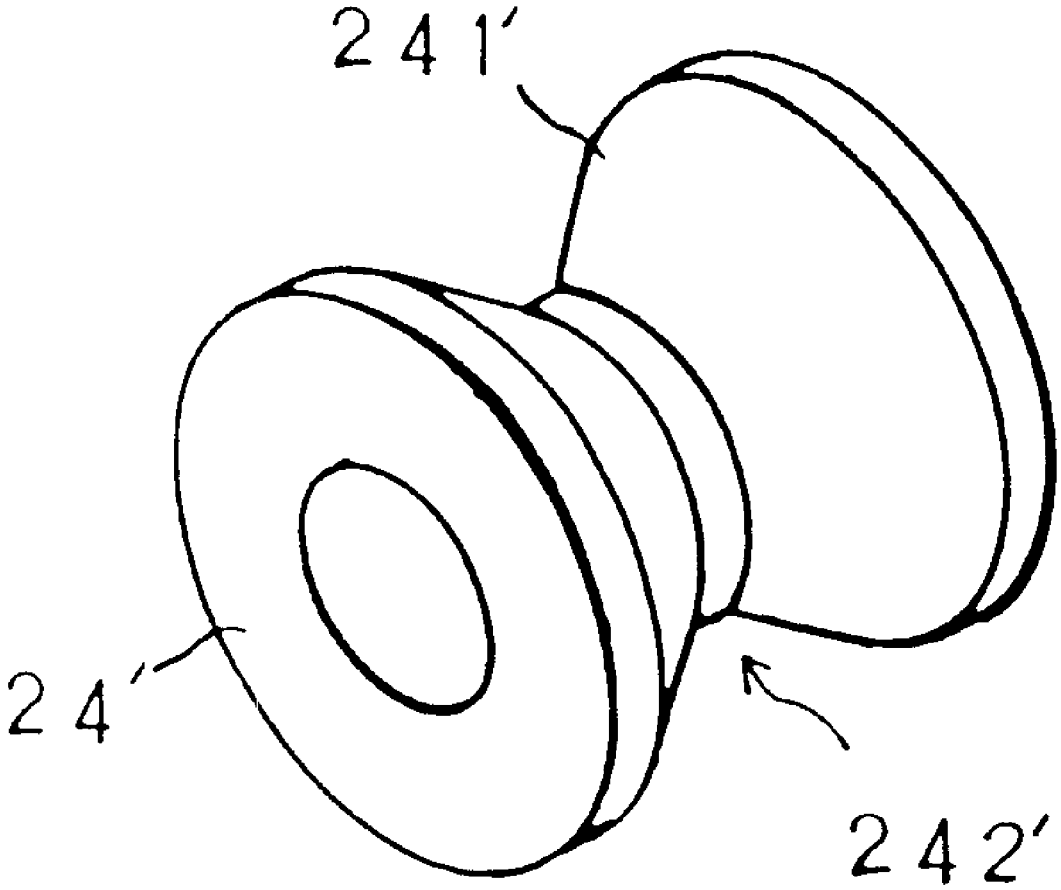
FIG. 6 is a perspective view of a dumbbell-shaped spool of a second preferred embodiment in accordance with the present invention.
Figure 7:
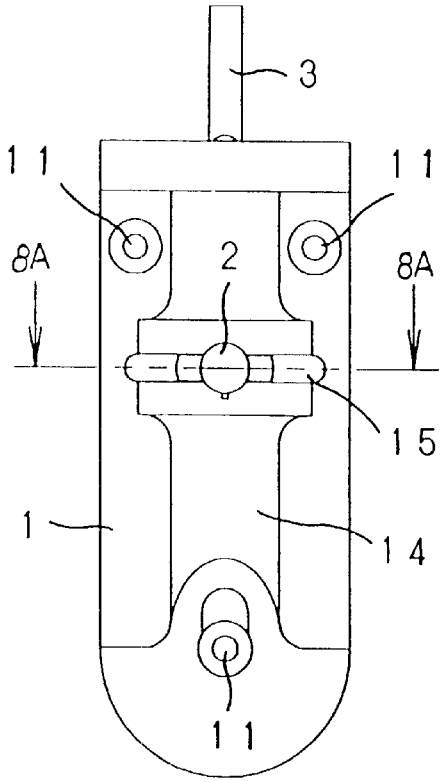
FIG. 7 is a front elevational view of a hanger device of a first referred embodiment without a hanger tube.
Figure 8:
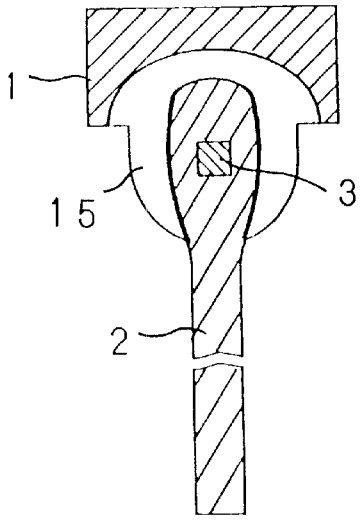
FIG. 8 is a sectional view taken along line 8A—8A in FIG. 7.

Referring to FIGS. 4 to 6, another hanger device comprises a support seat 1', a control rod 3', and a cantilever 2'.

The support seat 1' has an upper lug 10', a pair of middle lugs 14', and a semicircular slot 15' formed between the middle lugs 14'.

The upper lug 10' has a plurality of grooves 16'.

A post 31' is disposed on the control rod 3'.

The cantilever 2' is inserted in the semicircular slot 15' of the support seat 1'.

The control rod 3' passes through the upper lug 10', the support seat 1', and the cantilever 2'.

At least a dumbbell-shaped spool 24' has an annular groove 242' and two outer flared members 241'. The cantilever 2' is inserted through the dumbbell-shaped spool 24'.

The dumbbell-shaped spool 24' is made of reinforced plastics. Therefore, the dumbbell-shaped spool 24' will not slide.

The present invention is not limited to the above embodiments but various modification thereof may be made. Furthermore, various changes in form and detail may be made without departing from the scope of the present invention.

I claim:

1. A hanger device comprises:

a support seat, a control rod, and a cantilever, the support seat having an upper lug, a pair of middle lugs, a semicircular slot formed between the middle lugs, a plurality of threaded holes, and a longitudinal through aperture communicating with the semicircular slot, the upper lug having a center hole communicating with the longitudinal through aperture of the support seat, and a plurality of grooves communicating with the center hole, a post disposed on the control rod, the cantilever having a distal end and a proximal end having a through hole, the proximal end of the cantilever inserted in the semicircular slot of the support seat, the control rod passing through the center hole of the upper lug, the longitudinal through aperture of the support seat, and the through hole of the proximal end of the cantilever, and the post of the control rod inserted in one of the grooves of the upper lug.

2. The hanger device as claimed in claim 1, wherein the support seat is generally in an oblong shape.

3. The hanger device as claimed in claim 1, wherein the upper lug and the middle lugs have semicircular shapes.

4. The hanger device as claimed in claim 1, wherein the cantilever is made of metal.

5. The hanger device as claimed in claim 1, wherein a hanger tube surrounds the distal end of the cantilever.

6. The hanger device as claimed in claim 1, wherein the control rod has a square cross-section and the through hole of the proximal end of the cantilever has a square shape.

7. The hanger device as claimed in claim 1, wherein at least a dumbbell-shaped spool has an annular groove and two outer flared members, and the cantilever is inserted through the dumbbell-shaped spool.

8. The hanger device as claimed in claim 1, wherein the dumbbell-shaped spool is made of reinforced plastics.

* * * * *